US009388567B2

(12) United States Patent
Watanabe

(10) Patent No.: US 9,388,567 B2
(45) Date of Patent: Jul. 12, 2016

(54) WATER-STOPPING MEMBER AND OUTER WALL STRUCTURE

(71) Applicant: Nichiha Corporation, Nagoya-shi, Aichi (JP)

(72) Inventor: Hiroaki Watanabe, Nagoya (JP)

(73) Assignee: NICHIHA CORPORATION, Nagoya-Shi, Aichi (JP)

( * ) Notice: Subject to any disclaimer, the term of this patent is extended or adjusted under 35 U.S.C. 154(b) by 0 days.

(21) Appl. No.: 14/668,387

(22) Filed: Mar. 25, 2015

(65) Prior Publication Data

US 2016/0040419 A1 Feb. 11, 2016

(30) Foreign Application Priority Data

Aug. 8, 2014 (JP) ..... 2014-163001

(51) Int. Cl.

| | |
|---|---|
| ***E04B 1/682*** | (2006.01) |
| ***E04F 13/08*** | (2006.01) |
| ***E04B 1/68*** | (2006.01) |
| ***E04B 1/66*** | (2006.01) |
| ***E06B 1/02*** | (2006.01) |
| ***E06B 7/16*** | (2006.01) |

(52) U.S. Cl.

CPC ..... *E04B 1/6812* (2013.01); *E04B 1/665* (2013.01); *E04F 13/08* (2013.01); *E06B 1/02* (2013.01); *E06B 7/16* (2013.01)

(58) Field of Classification Search

CPC ..... E06B 1/02; E06B 7/12; E06B 1/66; E06B 1/36; E06B 1/16; E06B 1/702; E03B 1/702; E04B 1/6812; E04B 1/665; E04F 13/08

See application file for complete search history.

(56) References Cited

U.S. PATENT DOCUMENTS

| | | | | |
|---|---|---|---|---|
| 6,182,405 | B1 * | 2/2001 | Lindahl | 52/204.1 |
| 8,051,623 | B2 * | 11/2011 | Loyd | 52/747.1 |
| 2003/0221381 | A1 * | 12/2003 | Ting | 52/204.1 |
| 2006/0143996 | A1 * | 7/2006 | Alvarado | 52/204.53 |
| 2006/0236618 | A1 * | 10/2006 | Williams | 52/58 |
| 2010/0269432 | A1 * | 10/2010 | Furgerson et al. | 52/213 |
| 2014/0366469 | A1 * | 12/2014 | Hodgson et al. | 52/204.1 |

FOREIGN PATENT DOCUMENTS

| | | |
|---|---|---|
| JP | 2009-41181 A | 2/2009 |
| JP | 2012-1967 A | 1/2012 |

* cited by examiner

*Primary Examiner* — Adriana Figueroa
*Assistant Examiner* — Jessie Fonseca
(74) *Attorney, Agent, or Firm* — Birch, Stewart, Kolasch & Birch, LLP

(57) ABSTRACT

An outer wall structure according to the invention includes first to fourth linear water-stopping members, and first to fourth corner water-stopping members. These members include plate portions and seal portions and the like. The plate portions are fixed to a vertical furring strip member, a horizontal furring strip member, and a frame member by means of a first mounting screw. Consequently, the seal portions prevent entry of water between a sash body and the plate portion. With the outer wall structure, the plate portions are fixed to the vertical furring strip member, the horizontal furring strip member, and the frame member at a position spaced apart from the outer face farther than a first width of the flange.

10 Claims, 9 Drawing Sheets

WATER-STOPPING MEMBER AND OUTER WALL STRUCTURE

CROSS REFERENCE TO RELATED APPLICATIONS

This application is based on Japanese Patent Application No. 2014-163001 filed with the Japanese Patent Office on Aug. 8, 2014, the entire content of which is hereby incorporated by reference.

BACKGROUND OF THE INVENTION

1. Field of the Invention

The present invention relates to a water-stopping member and an outer wall structure.

2. Description of the Related Art

For example, in buildings such as houses, opening members such as a window sash and a door are fitted, and exterior building materials formed of ceramic are also mounted. In such a building, an opening portion is formed by using frame members such as a column member at a location where a window, an entrance, or the like is disposed, and the opening portion communicates the exterior side with the interior side of the building. In addition, a wall backing material such as a furring strip member is mounted onto the frame member. The wall backing material is located between the frame member and the interior side of the exterior building material as a result of the exterior building material being mounted onto the building.

The opening member includes an opening member body and a flange. The opening member body is disposed within the opening portion, and serves to open and close the opening portion, in other words, a window, an entrance or the like. The flange extends outward at a substantially right angle from the outer surface of the opening member body by a first width. As a result of the flange being fixed on the exterior side of the frame member, the opening member is fitted onto the building.

In order to prevent entry of rainwater or the like into the interior side of the building, a water-stopping member is provided to waterproof such a building between the opening member and the exterior building material. Such a water-stopping member and an outer wall structure using the water-stopping member are disclosed in JP 2012-001967A, for example.

The water-stopping member disclosed in JP 2012-001967A includes a plate portion, a supporting portion, and a seal portion. The plate portion is formed in a plate form having a second width that is longer than the first width of the flange and is longer than the interval between the opening member body and the exterior building material. In addition, a base portion for mounting a decorative member protrudes from the plate portion. The plate portion is fixed to the wall backing material and the frame member by means of a screw, and is located between the wall backing material and the exterior building material. The screw used to fix the plate portion penetrates through the distal end portion of the flange from the wall backing material, and reaches the frame member. Further, as a result of the plate portion being fixed to the wall backing material and the frame member, the base portion is disposed between the opening member body and the exterior building material and protrudes in the exterior direction.

The supporting portion is provided in the plate portion. The supporting portion is formed so as to extend at a substantially right angle in the exterior direction, and is integral with the base portion. The seal portion is provided at the supporting portion. An ethylene-propylene rubber (EPDM) or the like may be used as the seal portion.

With the water-stopping member, as a result of the plate portion being fixed to the wall backing material and the frame member as described above, the seal portion abuts the opening portion body, while being compressed and deformed between the opening member body and the supporting portion. This prevents entry of water into the interior side from between the plate portion and the opening member body.

With the water-stopping member, a caulking compound is filled between the base portion and the exterior building material, and the caulking compound prevents entry of water into the interior side from between the base portion and the exterior building material. After the caulking compound has been filled, the decorative member is mounted onto the base portion. This decorative member conceals the caulking compound, and the caulking compound will not be exposed on the exterior side. Note that JP 2012-001967A also discloses the provision of EPDM or the like material that is similar to that of the seal portion between the base portion and the exterior building material, in place of the caulking compound.

Thus, with the water-stopping member and an outer wall structure using the water-stopping member, the waterproofness of the building is ensured by waterproofing the building between the opening member and the exterior building material by using the caulking compound and the seal portion.

SUMMARY OF THE INVENTION

However, with the above-described conventional water-stopping member, there is the possibility that the screw used for fixing the plate portion may penetrate through the distal end portion of the flange from the wall backing material, and a hole may be formed by the screw in the distal end portion of the flange. In this case, rainwater or the like may enter into the interior side of the building through the hole. For this reason, with the water-stopping member, the caulking compound is filled between the base portion and the exterior building material as described above, thus preventing rainwater or the like from entering inside the building through the hole formed in the flange.

As described above, at the time of waterproofing the building between the opening member and the exterior building material in order to ensure the waterproofness of the building, the use of the water-stopping member requires not only the waterproofing between the plate portion and the opening member body by using the seal portion, but also the waterproofing between the plate portion and the opening member body by using the caulking compound. Accordingly, the use of the water-stopping member and an outer wall structure using the water-stopping member leads to complicated installation and an increase in cost.

The present invention was made in view of the above-described conventional circumstances, and it is an object of the invention to provide a water-stopping member and an outer wall structure that can achieve simplified installation and cost reduction, while ensuring the waterproofness of the building onto which the opening member and the exterior building material are mounted.

A water-stopping member that is to be provided in a building having an opening member and an exterior building material for waterproofing a boundary portion between the opening member and the exterior building material, wherein the building includes a frame member, and a wall backing material that is mounted to the frame member and is located between the frame member and an interior side of the exterior building material, the opening member includes an opening member body, and a flange that extends outward from an outer surface of the opening member body by a first width and to be fixed on an exterior side of the frame member, the water-stopping member includes:

a plate portion configured to be fixed to at least one of the wall backing material and the frame member, and to be located between the wall backing material and the exterior building material;

a supporting portion provided in the plate portion to face the opening portion body; and a seal portion provided in the supporting portion and capable of preventing entry of water by abutting the opening portion body, wherein the plate portion is formed in a plate form having a second width that is longer than the first width and is longer than an interval between the opening member body and the exterior building material, and the plate portion is fixed to at least one of the wall backing material and the frame member by a fitting at a position spaced apart from the opening member body farther than the first width.

DESCRIPTION OF THE PREFERRED EMBODIMENTS

Figure 1:
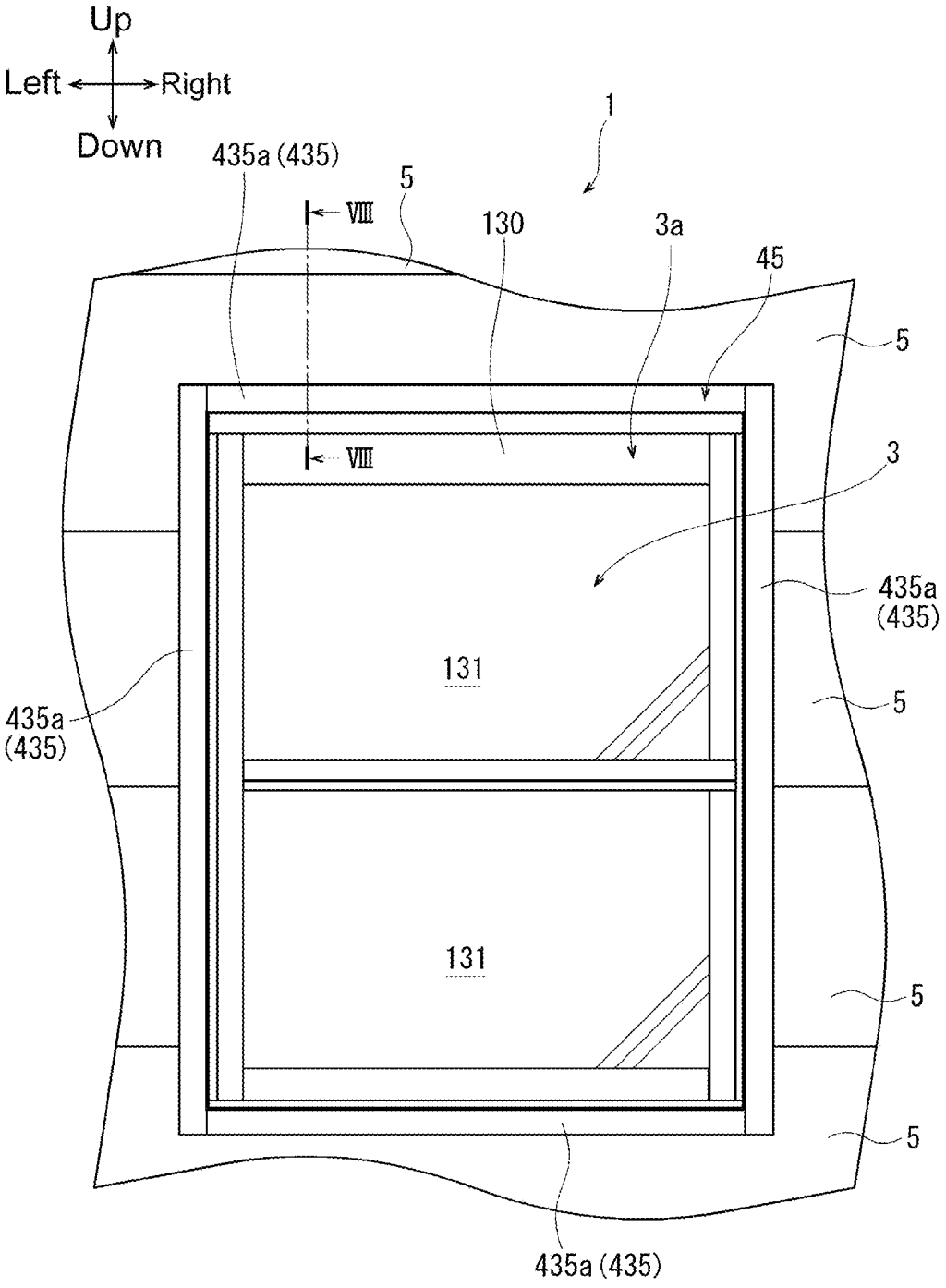
FIG. 1 is a partial front view showing a part of a building in which an outer wall structure according to Embodiment 1 is used.

A water-stopping member is provided in a building onto which an opening member and an exterior building material are mounted for waterproofing between the opening member and the exterior building material in the building.

The building includes a frame member that forms an opening portion communicating an exterior side of the building with an interior side of the building, and a wall backing material that is mounted onto the frame member and is located between the frame member and the interior side of the exterior building material.

The opening member includes an opening member body disposed within the opening portion, and a flange that extends outward at a substantially right angle from an outer surface of the opening member body by a first width to be fixed on the exterior side of the frame member.

The water-stopping member includes a plate portion that is to be fixed to at least one of the wall backing material and the frame member, and is to be located between the wall backing material and the exterior building material, a supporting portion that is to be provided in the plate portion to face the opening portion body, and a seal portion that is to be provided in the supporting portion and capable of stopping entry of water by abutting the opening portion body.

The plate portion is formed in a plate form having a second width that is longer than the first width and is longer than an interval between the opening member body and the exterior building material.

The plate portion is fixed to at least one of the wall backing material and the frame member by means of a nail or a screw at a position spaced apart from the opening member body farther than the position with the first width from the opening member.

In the water-stopping member, the plate portion has the second width, and is located between the wall backing material and the exterior building material by being fixed to the wall backing material and the frame member by means of a screw or a nail. Consequently, the seal portion is disposed between the opening portion body and the supporting portion to prevent entry of water into the building by abutting the opening portion body.

Here, in the water-stopping member, the plate portion is fixed to the wall backing material and the frame member at a position spaced apart from the opening member body farther than the first width of the flange. More particularly, the plate portion is fixed to both of the wall backing material and the frame member by means of a nail or a screw, or fixed to only the wall backing material by means of a nail or a screw. In addition, the plate portion can have a portion that is fixed to both of the wall backing material and the frame member by means of a nail or a screw, and a portion that is fixed to the wall backing material only by means of a nail or a screw. In any of these cases, the plate portion is fixed at a position spaced apart from the opening member body farther than the first width of the flange. In other words, the plate portion is fixed to at least one of the wall backing material and the frame member at a position where the flange is not present. Accordingly, with the water-stopping member, when the plate portion is fixed to both of the wall backing material and the frame member by means of a nail or a screw, no additional hole will be formed in the flange as a result of this fixation. Even if a nail or a screw penetrates through the wall backing material when the plate portion is fixed only to the wall backing material by means of a nail or a screw, the distal end of the nail or screw does not contact the flange to prevent the damage of the flange.

Consequently, with the water-stopping member, the seal portion seals between the plate portion and the opening member body when the waterproofing is performed between the opening member and the exterior building material in order to ensure the waterproofness of the building. Thus, it is not necessary to perform waterproofing by using a caulking compound or the like at other positions between the opening member and the exterior building material.

Thus, the water-stopping member achieves simplified installation and cost reduction, while ensuring the waterproofness of the building onto which the opening member and the exterior building material are mounted.

In particular, with the water-stopping member, the fixation of the plate portion to the wall backing material and the frame member can brings the seal portion into abutment with the opening portion body, thus making it possible to perform waterproofing between the plate portion and the opening member body. This makes it possible to perform waterproofing easily as compared with a case where waterproofing is performed by separately filling a caulking compound between the plate portion and the opening member body, and also to reduce locational variations in the waterproofing capability. In this respect as well, the water-stopping member achieves simplified installation.

Examples of the frame member in the water-stopping member include a through column, a stand column, a stud, a window sill, and a lintel. Examples of the wall backing material include a furring strip member and plywood. These frame members and the wall backing materials are formed of wood or any other material.

The exterior building material is formed of any of various materials, for example, ceramic.

Examples of the opening member include a door and the like provided at the entrance of a building, in addition to a window sash provided at a window of the building. The opening member body includes a member or a device capable of opening and closing the window, the entrance, or the like.

The seal portion is formed of a sealing material, for example, a resin material such as an ethylene-propylene rubber (EPDM) or a synthetic rubber, and also is formed of various materials capable of stopping entry of water.

In the water-stopping member, the plate portion can include an abutment portion capable of shielding the seal portion while abutting the opening member body. In addition, an exterior face located on the exterior side of the building and an interior face located on the interior side of the building can be defined on the plate portion. Furthermore, the abutment portion can be formed so as to extend from a side of the exterior face in the exterior direction of the building. Also, it is preferable that the supporting portion is formed so as to extend from a side of the interior face in the interior direction of the building.

In this case, since the supporting portion extends from the interior face side in the interior direction, the seal portion provided in the supporting portion is located on the interior side with respect to the abutment portion. Also, with this water-stopping member, the seal portion is concealed from the exterior side by the abutment portion, it is possible to reduce the degradation of the seal portion, thus increasing the durability of the water-stopping member. Here, the durability of the abutment portion is increased when the abutment portion is made of metal, and it is thus possible to further increase the durability of the water-stopping member. It is also possible to enhance the aesthetic appearance of the building by concealing the seal portion by the abutment portion.

The abutment portion is, for example, a dedicated member formed as a separated part from the plate portion, or a part formed integrally with the plate portion to provide the abutment portion in the plate portion.

In the water-stopping member, an engaging groove can be formed in an end face of the exterior building material. Furthermore, the plate portion can include a securing portion capable of being used for mounting the exterior building material onto the building by securing the end face of the exterior building material by being inserted into the engaging groove. In addition, an exterior face located on the exterior side and an interior face located on the interior side can be defined on the plate portion. Also, it is preferable that the securing portion is provided on a side of the exterior face at a position located closer to the opening member body than the first width.

In this case, the water-stopping member can also be used to mount the exterior building material to the building, in addition to waterproofing the building between the opening member and the exterior building material. At this time, in order to mount the exterior building material to the building by securing the end face of the exterior building material to the securing portion, it is not necessary to perform nailing or screwing. Accordingly, mounting the exterior building material onto the building by using the water-stopping member will not cause damage of the exterior building material or reduction in the aesthetic appearance of the building.

The securing portion secures the end face of the exterior building material by being inserted into the engaging groove formed in the exterior building material. Accordingly, this water-stopping member enables the securing portion to favorably secure the exterior building material while reducing the warping of the exterior building material over time, without separately performing bonding or the like of the exterior building material to the plate portion, for example. These effects are more prominent when the exterior building material is formed of ceramic.

Since the securing portion is provided on the side of the exterior face of the plate portion at a position located closer to the opening member body than the first width of the flange, the securing portion is disposed close to the opening member body by fixing the plate portion to the wall backing material and the frame member. Accordingly, with this water-stopping member, it is possible to reduce the interval between the exterior building material and the opening member body when the exterior building material is secured to the securing portion.

The provision of the securing portion on the exterior face of the plate portion can be achieved, for example, by mounting a member including the securing portion on the exterior face side of the plate portion, or can be achieved by forming the securing portion integrally with the exterior face of the plate portion.

An outer wall structure includes a water-stopping member provided in a building onto which an opening member and an exterior building material are mounted, for waterproofing the building between the opening member and the exterior building material in the building.

The building includes a frame member that forms an opening portion communicating an exterior side of the building with an interior side of the building, and a wall backing material that is mounted onto the frame member and is located between the frame member and the interior side of the exterior building material.

The opening member includes an opening member body disposed within the opening portion, and a flange that extends outward at a substantially right angle from an outer surface of the opening member body by a first width to be fixed on the exterior side of the frame member.

The water-stopping member includes a plate portion that is to be fixed to at least one of the wall backing material and the frame member, and is to be located between the wall backing material and the exterior building material, a supporting portion that is to be provided in the plate portion to face the opening portion body, and a seal portion that is to be provided in the supporting portion and capable of stopping entry of water by abutting the opening portion body.

The plate portion is formed in a plate form having a second width that is longer than the first width and is longer than an interval between the opening member body and the exterior building material.

The plate portion is fixed to at least one of the wall backing material and the frame member by means of a nail or a screw at a position spaced apart from the opening member body farther than the position with the first width from the opening member.

The outer wall structure uses a water-stopping member having the above-described features. Accordingly, with this outer wall structure, when waterproofing is performed between the plate portion and the opening member body by the seal portion at the time of waterproofing the building between the opening member and the exterior building material in order to ensure the waterproofness of the building, it is not necessary to perform waterproofing by using a caulking compound or the like at other positions between the opening member and the exterior building material.

Therefore, the outer wall structure achieves simplified installation and cost reduction, while ensuring the waterproofness of the building onto which the opening member and the exterior building material are mounted.

The water-stopping member achieves simplified installation and cost reduction, while ensuring the waterproofness of the building onto which the opening member and the exterior building material are mounted. Further, the outer wall structure achieves simplified installation and cost reduction, while ensuring the waterproofness of the building onto which the opening member and the exterior building material are mounted In the following, Embodiments 1 and 2 of the present invention will be described with reference to the drawings.

(Embodiment 1)

An outer wall structure according to Embodiment 1 is used in a building 1 as a house shown in FIG. 1. A window sash 3 and a plurality of exterior building materials 5 are mounted onto the building 1. The window sash 3 corresponds to an opening member. The exterior building materials 5 are formed of ceramic. As such an exterior building material 5, it is possible to use, for example, "Moen Excelard (Japanese Registered Trademark)" manufactured by NICHIHA CORPORATION.

Figure 2:
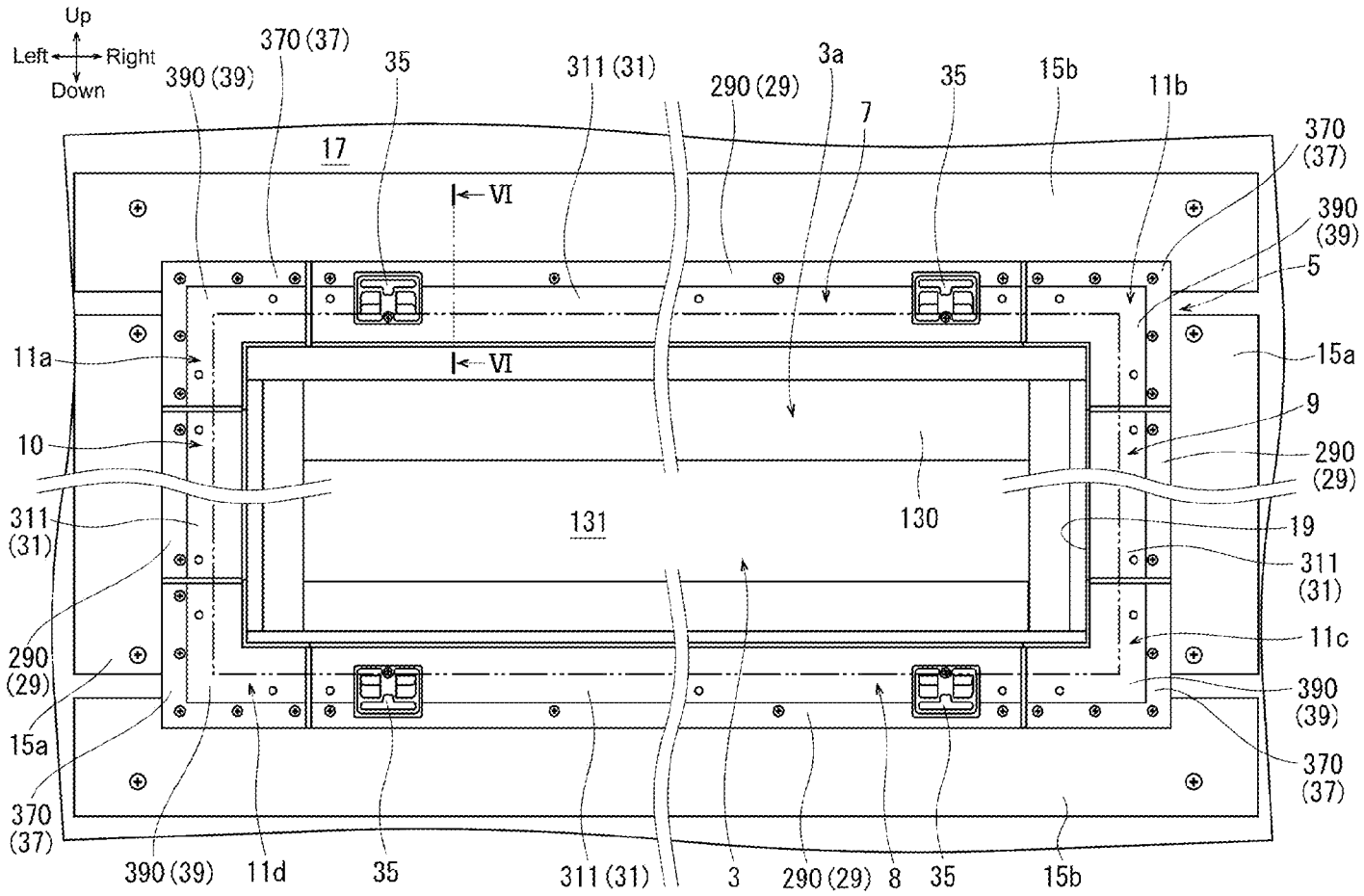
FIG. 2 is a partial front view of an area surrounding a window sash according to the outer wall structure of Embodiment 1.

As shown in FIG. 2, this outer wall structure includes first to fourth linear water-stopping members 7 to 10 and first to fourth corner water-stopping members 11*a* to 11*d*. With the outer wall structure, the first to fourth linear water-stopping members 7 to 10 and the first to fourth corner water-stopping members 11*a* to 11*d* are used to waterproof the building 1 between the window sash 3 and the exterior building materials 5, and to mount the exterior building materials 5 in an upside portion and a downside portion of the window sash 3. Note that in order to simplify the description, the exterior building material 5 is depicted by two-dot chain lines in FIG. 2 and the illustration of a decorative member 45, which will be described later, has been omitted.

Figure 3:
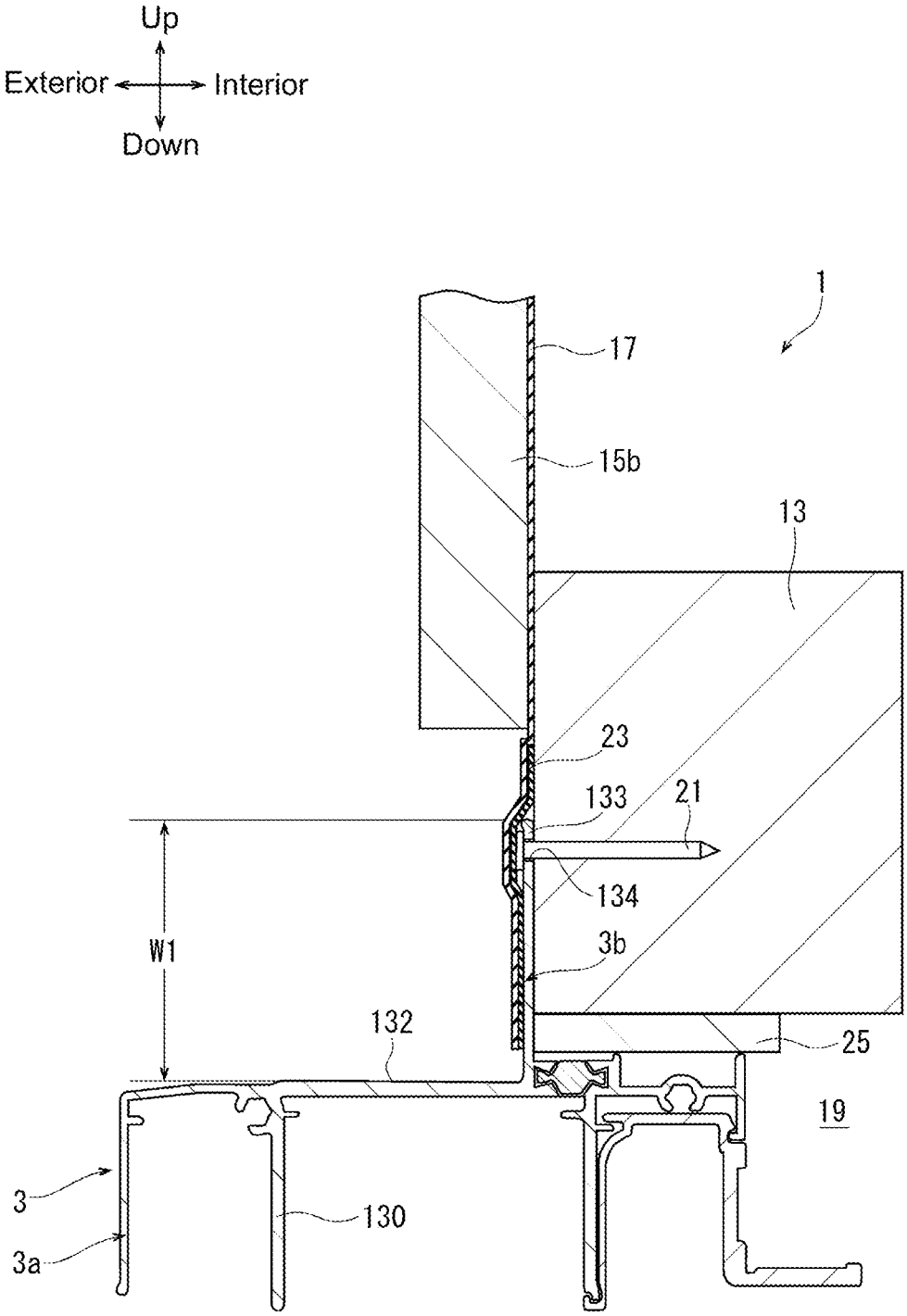
FIG. 3 is an enlarged cross-sectional view of a principal part showing a state in which the window sash is fitted onto a building according to the outer wall structure of Embodiment 1.
Figure 6:
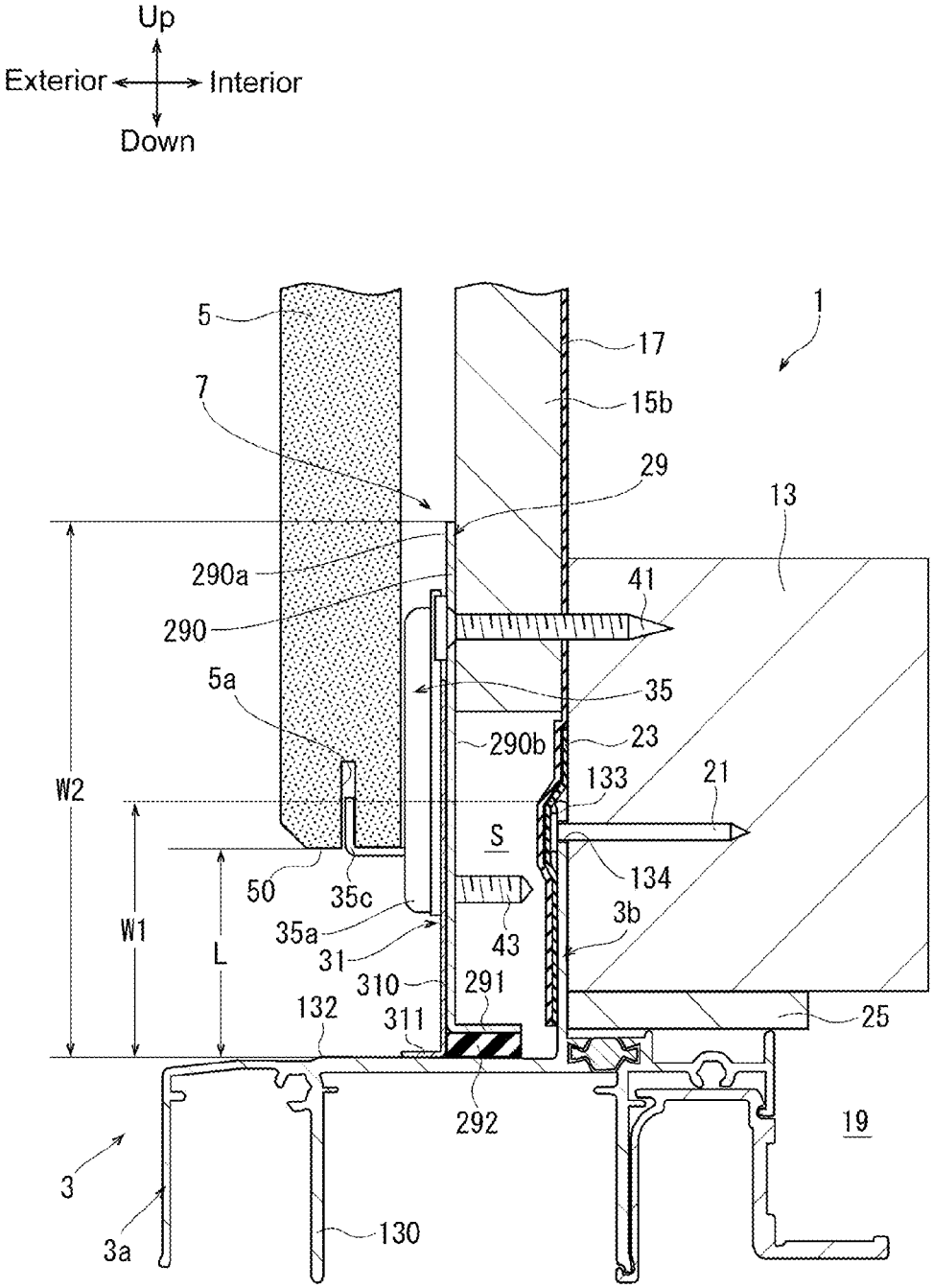
FIG. 6 is an enlarged cross-sectional view looking in the direction of arrows VI-VI in FIG. 2 according to the outer wall structure of Embodiment 1.
Figure 8:
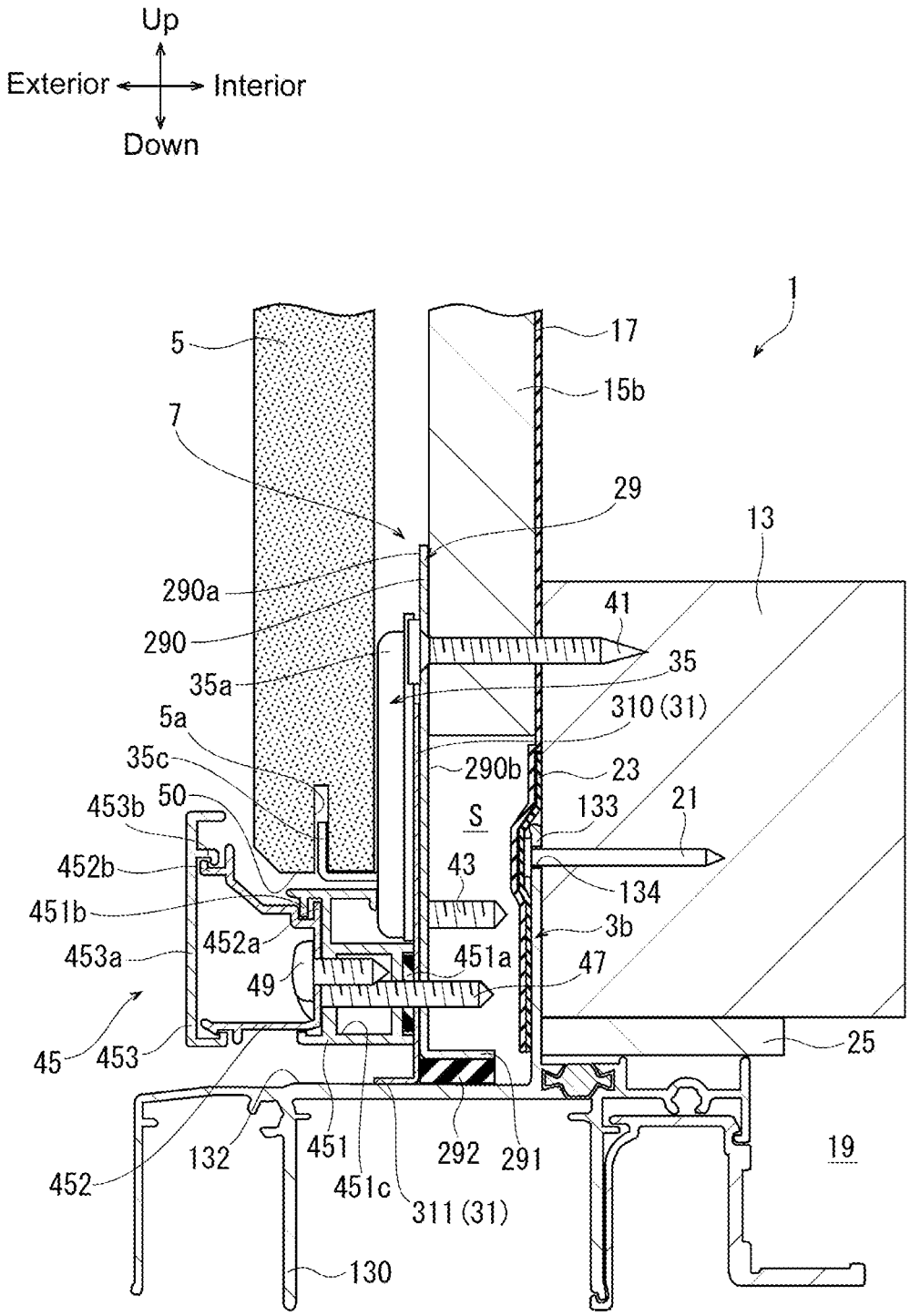
FIG. 8 is an enlarged cross-sectional view looking in the direction of arrows VIII-VIII in FIG. 1 according to the outer wall structure of Embodiment 1.

The building 1 is a wooden-framed building, and includes, in addition to a frame member 13 shown in FIG. 3, a plurality of vertical furring strip members 15*a*, a plurality of horizontal furring strip members 15*b*, and the like shown in FIG. 2. The vertical furring strip members 15*a* and the horizontal furring strip members 15*b* correspond to wall backing materials. The building 1 is formed by assembling the frame member 13, the vertical furring strip members 15*a*, the horizontal furring strip members 15*b*, and the like by a known construction method. Additionally, a plurality of frame members 13 are provided, and only one of the frame members 13 is shown in FIG. 3 and FIGS. 6 and 8, which will be described later. Further, as shown in FIG. 2, a waterproof sheet 17 (i.e., a waterproof material) is provided between the frame members 13 and the vertical and the horizontal furring strip members 15*a*, 15*b*.

In the building 1, the plurality of frame members 13 are assembled into a frame, thus forming a rectangular opening portion 19 as shown in FIG. 2. The opening portion 19 corresponds to a window of the building 1, and communicates the exterior side and the interior side of the building 1 with each other as shown in FIG. 3. In addition, as shown in FIG. 2, the vertical furring strip members 15*a* are fixed to the frame members 13 on the right side and the left side of the opening portion 19 in FIG. 2. The horizontal furring strip members 15*b* are fixed to the frame members 13 in an upside portion and a downside portion of the opening portion 19. Consequently, the opening portion 19 is surrounded by the vertical furring strip members 15*a* and the horizontal furring strip members 15*b*. Further, the vertical furring strip members 15*a* and the horizontal furring strip members 15*b* are located between the frame member 13 and the interior side of the exterior building material 5 when the exterior building materials 5 are mounted onto the building 1.

The window sash 3 shown in FIG. 1 is in common use, and includes a sash body 3*a* and a flange 3*b* shown in FIG. 3. The sash body 3*a* corresponds to an opening member body. As shown in FIG. 1, the sash body 3*a* includes a plurality of frames 130 made of an aluminum alloy and a plurality of sheets of window glass 131 mounted onto the frames 130. Consequently, the sash body 3*a* has the shape of a rectangular frame.

As shown in FIG. 3, the flange 3*b* is provided integrally with the sash body 3*a*, and extends outwardly at a substantially right angle from an outer surface 132 of the sash body 3*a*. More specifically, the flange 3*b* is formed to have a length of a first width W1, and extends outward by the first width W1 from the outer surface 132 of the sash body 3*a*. Consequently, the length from the outer surface 132 of the sash body 3*a* to a distal end portion 133 of the flange 3*b* is equal to the first width W1. Additionally, a plurality of mounting holes 134 are formed in the flange 3*b*. Each of the mounting holes 134 is formed in the flange 3*b* on the inner side with respect to the distal end portion 133, in other words, at a position closer to the sash body 3*a* than the distal end portion 133.

The outer wall structure is installed by performing the following steps.

First, an opening member mounting step is performed in which the window sash 3 is provided in the building 1. Specifically, the flange 3*b* is brought into contact with the exterior side of the frame member 13 while the sash body 3*a* is disposed within the opening portion 19. In this state, a nail 21 is inserted through each of the mounting holes 134, and the nails 21 are driven into the frame member 13 from the exterior side of the building 1, thus fixing the flange 3*b* on the exterior side of the frame member 13. Here, as described above, each of the mounting holes 134 is formed at a position closer to the sash body 3*a* than the distal end portion 133 of the flange 3*b*. Thus, the flange 3*b* is fixed on the exterior side of the frame member 13 at a position closer to the outer surface 132 of the sash body 3*a* than the distal end portion 133 of the flange 3*b*. After the flange 3*b* has been fixed to the frame member 13, a waterproof tape 23 (i.e., a waterproof material) is attached to the frame member 13 and the flange 3*b*. Additionally, the above-described waterproof sheet 17 covers the exterior side of the waterproof tape 23. Accordingly, waterproof treatment between the frame member 13 and the flange 3*b* is provided.

Although not shown in the drawings, a plurality of mounting holes are formed in the sash body 3*a*, and the sash body 3*a* is fixed to the frame member 13 also by means of mounting screws inserted through the mounting holes. Note that to provide the window sash 3 to the building 1, a spacer member 25 is provided as appropriate between the frame member 13 and the sash body 3*a*. In this way, the window sash 3 is provided in the building 1, thus completing the opening member mounting step.

Figure 4:
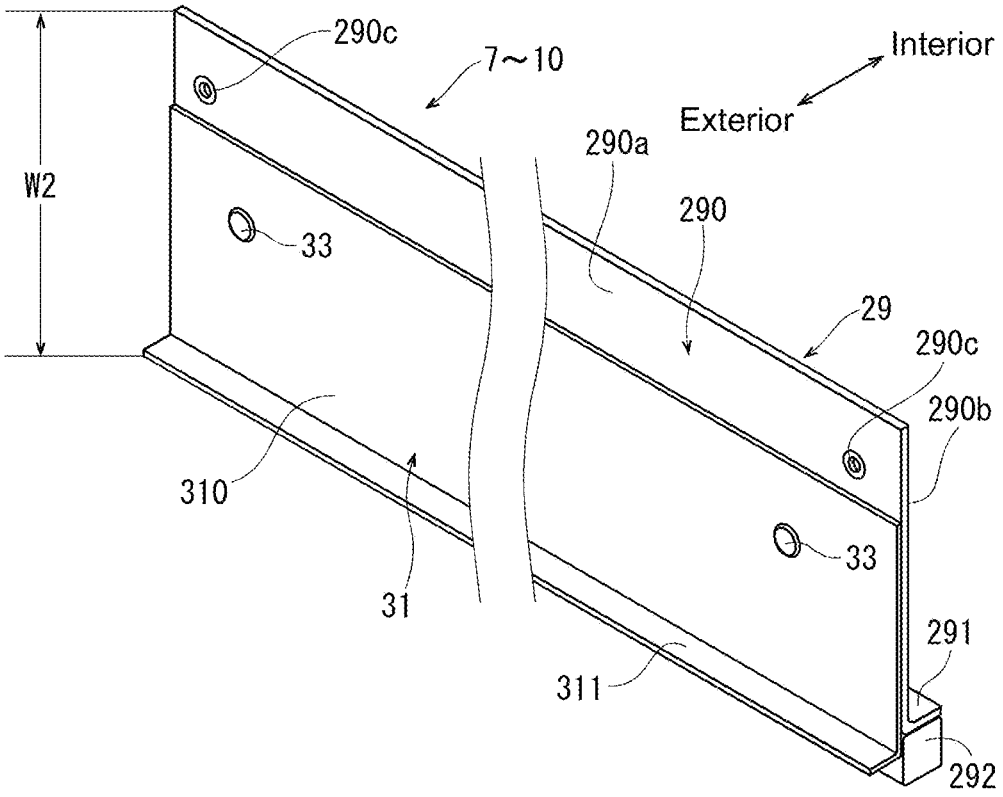
FIG. 4 is a perspective view showing first to fourth linear water-stopping members according to the outer wall structure of Embodiment 1.
Figure 5:
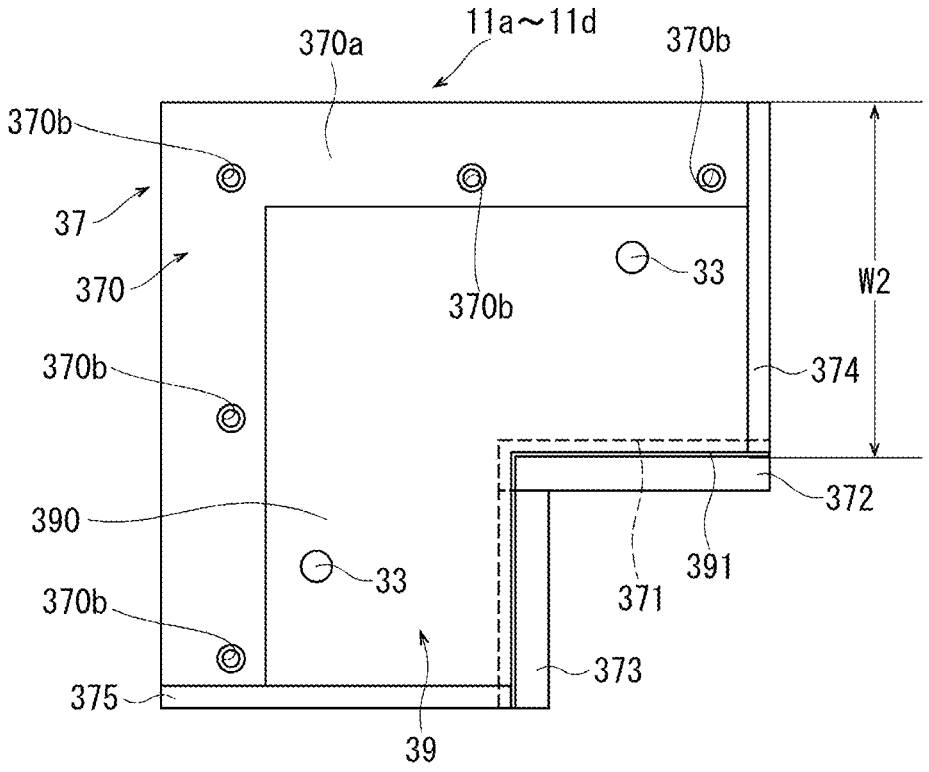
FIG. 5 is a front view showing first to fourth corner water-stopping members according to the outer wall structure of Embodiment 1.

Next, a water-stopping member mounting step is performed in which the first to fourth linear water-stopping members 7 to 10 shown in FIG. 4 and the first to fourth corner water-stopping members 11*a* to 11*d* shown in FIG. 5 are mounted onto the building 1 around the sash body 3*a*. First, the configurations of the first to fourth linear water-stopping members 7 to 10 and the first to fourth corner water-stopping members 11*a* to 11*d* will be described in detail.

The first to fourth linear water-stopping members 7 to 10 have substantially the same configuration. In the following, the configuration will be described on the basis of the first linear water-stopping member 7. As shown in FIG. 4, the first linear water-stopping member 7 is formed by combining a water-stopping plate body 29 and an auxiliary plate 31. The water-stopping plate body 29 includes a plate portion 290, a supporting portion 291, and a seal portion 292.

As shown in FIG. 6, the plate portion 290 includes an exterior face 290*a* that faces the exterior side of the building 1 when the first to fourth linear water-stopping members 7 to 10 are mounted onto the building 1, and an interior face 290*b*, which is the back side of the exterior face 290*a*, that faces the interior side of the building 1. As shown in FIG. 4, the plate portion 290 is formed of a metal plate extending from one end side (first end side) to the other end side (second end side) in the width direction and also extending in the longitudinal direction of the sash body 3*a*, and the plate portion 290 has the shape of a substantially rectangular plate. Here, the length of the plate portion 290 in the longitudinal direction in the first and second linear water-stopping members 7 and 8 is set according to the length of the sash body 3*a* in the left-right direction (i.e., a horizontal direction), as shown in FIG. 2. The length of the plate portion 290 in the longitudinal direction in the third and fourth linear water-stopping members 9 and 10 is set according to the length of the sash body 3*a* in the up-down direction (i.e., a vertical direction) in FIG. 2.

As shown in FIG. 4, a plurality of mounting holes 290*c* (e.g., two mounting holes 290*c* in FIG. 2) are formed on the first end side portion of the plate portion 290. As shown in FIG. 6, the positions of the mounting holes 290*c* in the plate portion 290 are set such that the plate portion 290 is fixed at a position spaced apart from the outer surface 132 of the sash body 3*a* farther than the first width W1 of the flange 3*b* when the first linear water-stopping member 7 is mounted onto the building 1.

As shown in FIG. 4, the supporting portion 291 is formed integrally with the plate portion 290 by press-working a metal plate. More specifically, the supporting portion 291 is formed so as to extend toward the interior side of the building 1 by bending the metal plate at a substantially right angle when the supporting portion 291 is attached to the building 1. Note that the plate portion 290 and the supporting portion 291 can be formed of a material other than metal.

The seal portion 292 is formed of a sealing material such as an ethylene-propylene rubber (EPDM) having a rectangular shape. The seal portion 292 is provided on the supporting portion 291 with the sealing material attached onto the supporting portion 291.

The auxiliary plate 31 is formed of a metal plate having a smaller thickness than the metal plate that forms the plate portion 290 and the supporting portion 291 of the water-stopping plate body 29. The auxiliary plate 31 has the shape of a substantially rectangular plate extending from one end side (first end side) to the other end side (second end side) in the width direction and also extending in the longitudinal direction. Note that the length of the auxiliary plate 31 in the longitudinal direction is set according to the length of the plate portion 290 in the longitudinal direction.

A wall portion 310 and an abutment portion 311 are formed in the auxiliary plate 31. The wall portion 310 is formed flat, and extends in the width direction and the longitudinal direction of the auxiliary plate 31. The abutment portion 311 is formed with the wall portion 310 by press-working the metal plate so as to bend the metal plate at a substantially right angle toward the exterior side of the building 1 when the first linear water-stopping member 7 is attached to the building 1. Note that the auxiliary plate 31 can be formed of a material other than metal.

The auxiliary plate 31 is joined to the plate portion 290 by means of a plurality of rivets 33, with the wall portion 310 abutting the exterior face 290*a* of the plate portion 290. At this time, the auxiliary plate 31 is joined to the plate portion 290 at a position closer to the second end side of the plate portion 290 than the mounting holes 290*c* in order to prevent the wall portion 310 from covering the mounting holes 290*c*. Consequently, the water-stopping plate body 29 and the auxiliary plate 31 are integrated with each other, with the auxiliary plate 31 being located on the side of the exterior face 290*a* in the plate portion 290. In this way, in the first linear water-stopping member 7, the abutment portion 311 extends from the side of the exterior face 290*a* in the plate portion 290 in the exterior direction of the building 1.

The length from one end side (first end side) to the other end side (second end side) of the first to fourth linear water-stopping members 7 to 10, in other words, the length from the first end side of the plate portion 290 to the abutment portion 311, is equal to a second width W2.

Here, as shown in FIG. 6, the second width W2 is longer than the first width W1 of the flange 3*b*, and is longer than an interval L between the outer surface 132 of the sash body 3*a* and the end face 50 of the exterior building material 5 when the exterior building material 5 is mounted onto the building 1.

Figure 7A:
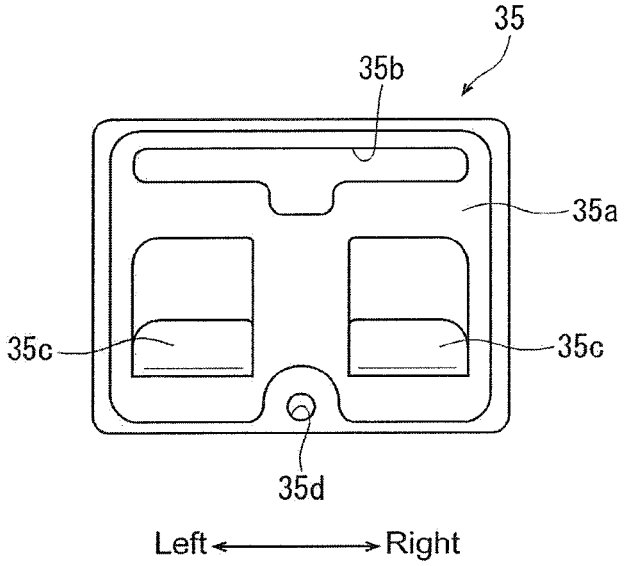
FIG. 7A is an enlarged front view showing a securing member according to the outer wall structure of Embodiment 1.
Figure 7B:
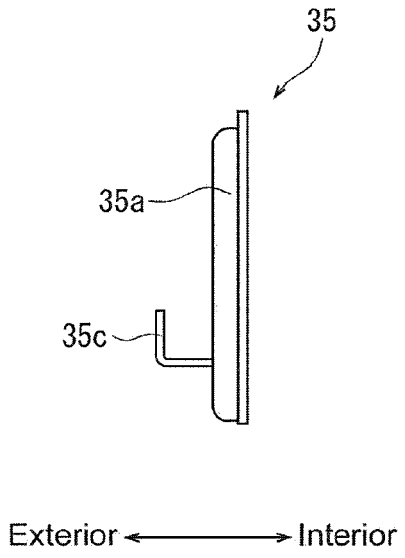
FIG. 7B is an enlarged side view showing the securing member according to the outer wall structure of Embodiment 1.

As shown in FIG. 2, a plurality of securing members 35 are fixed to the first and second linear water-stopping members 7 and 8. As shown in FIGS. 7A and 7B, each securing member 35 has a substantially rectangular shape. The securing member 35 is provided with a main body portion 35*a*, a rib 35*b*, a pair of securing portions 35*c*, and a mounting hole 35*d* as shown in FIG. 7A by subjecting a metal plate to punching and bending by press working.

As shown in FIG. 7B, the main body portion 35*a* has a shape in which the central portion protrudes. As shown in FIG. 7A, the rib 35*b* is formed by providing a recess on one end side of the main body portion 35*a*. The securing portions 35*c* are located on the right side and the left side of the main body portion 35*a*, respectively. Each of the securing portions 35*c* is formed by cutting out a tab surrounded by a substantially U-shaped slit from the main body portion 35*a*, bending the proximal end portion of the tab so as to stand at a substantially right angle from the main body portion 35*a*, and bending the distal end portion of the tab at a substantially right angle to parallel the main body portion 35*a*. Consequently, as shown in FIG. 7B, each of the securing portions 35*c* has a substantially crank-like shape protruding from the main body portion 35*a*. As shown in FIG. 7A, the mounting hole 35*d* is formed on the other end side of the main body portion 35*a* at substantially the center in the left-right direction in FIG. 7A. Note that the shape of the securing portions 35*c* is designed as appropriate according to the thickness or the like of the exterior building material 5.

As a result of mounting the securing member 35, the first and second linear water-stopping members 7 and 8, among the first to fourth linear water-stopping members 7 to 10, include a plurality of securing portions 35*c*, in addition to the plate portion 290, the supporting portion 291, the seal portion 292, and the abutment portion 311 described above. Note that the mounting of the securing member 35 onto the first and second linear water-stopping members 7 and 8 will be described later.

All of the first to fourth corner water-stopping members 11*a* to 11*d* shown in FIG. 5 have the same configuration. Also, the first to fourth corner water-stopping members 11*a* to 11*d* have substantially the same configuration as that of the above-described first to fourth linear water-stopping members 7 to 10, and are formed by combining a water-stopping plate body 37 and an auxiliary plate 39. The water-stopping plate body 37 includes a plate portion 370, a supporting portion 371, and seal portions 372 to 375.

As with the above-described plate portion 290, the plate portion 370 is also formed by a metal plate, and includes an exterior face 370*a* and an interior face (not shown), which is the back side of the exterior face 370*a*. The plate portion 370 extends from one end side (first end side) to the other end side (second end side) with the same width as that of the plate portion 290, and is substantially L-shaped in plan view. Also, a plurality of mounting holes 370*b* are formed in the plate portion 370. The positions of the mounting holes 370*b* in the plate portion 370 are also set such that the plate portion 370 is fixed at a position spaced apart from the outer surface 132 of the sash body 3*a* farther than the first width W1 of the flange 3*b* when the first to fourth corner water-stopping members 11*a* to 11*d* are mounted onto the building 1.

As with the above-described supporting portion 291, the supporting portion 371 is formed with the plate portion 370 by press-working a metal plate so as to extend toward the interior side of the building 1 by bending the metal plate at a substantially right angle when the supporting portion 371 is attached to the building 1. Here, since the plate portion 370 is substantially L-shaped in plan view as described above, the supporting portion 371 is also substantially L-shaped in the same manner. Note that the plate portion 370 and the supporting portion 371 can be formed of a material other than metal.

The seal portions 372 to 375 are formed of a sealing material such as an ethylene-propylene rubber (EPDM) as with the above-described seal portion 292. Each of the seal portions 372 and 373 is provided on the supporting portion 391 with the sealing material attached onto the supporting portion 391. The seal portions 374 and 375 are provided to the two side faces of the plate portion 370, respectively.

The auxiliary plate 39 is formed of the same metal plate as the metal plate forming the above-described auxiliary plate 31. The auxiliary plate 39 extends from one end side (first end side) to the other end side (second end side) with the same width as that of the auxiliary plate 31. In addition, the auxiliary plate 39 is also substantially L-shaped in plan view as with the plate portion 370.

A wall portion 390 and an abutment portion 391 are formed in the auxiliary plate 39. The wall portion 390 is formed flat. As with the above-described abutment portion 311, the abutment portion 391 is formed with the wall portion 390 by press-working the metal plate so as to bend the metal plate at a substantially right angle toward the exterior side of the building 1 when the first corner water-stopping member 11*a* is attached to the building 1. Note that the auxiliary plate 39 can be formed of a material other than metal.

The auxiliary plate 39 is joined to the plate portion 370 by means of a plurality of rivets 33, with the wall portion 390 abutting the exterior face 370*a* of the plate portion 370. At this time, the auxiliary plate 39 is also joined to the plate portion 370 at a position closer to the second end side of the plate portion 370 than the mounting holes 370*b* in order to prevent the wall portion 390 from covering the mounting holes 370*b*. Consequently, the water-stopping plate body 37 and the auxiliary plate 39 are integrated with each other, with the auxiliary plate 39 being located on the side of the exterior face 370*a* in the plate portion 370. In this way, in the first to fourth corner water-stopping members 11*a* to 11*d* as well, the abutment portion 391 extends from the side of the exterior face 370*a* in the plate portion 370 in the exterior direction of the building 1. Then, the length from the first end side of the plate portion 370 to the abutment portion 391 in the first to fourth corner water-stopping members 11*a* to 11*d* is also equal to the second width W2, as with the first to fourth linear water-stopping members 7 to 10.

To mount the first to fourth linear water-stopping members 7 to 10 and the first to fourth corner water-stopping members 11*a* to 11*d* to the building 1, first, the first to fourth corner water-stopping members 11*a* to 11*d* are disposed at the corresponding corner portions of the sash body 3*a* as shown in FIG. 2, and are fixed to the vertical furring strip members 15*a*, the horizontal furring strip members 15*b*, and the frame members 13. In this way, each of the first to fourth corner water-stopping members 11*a* to 11*d* is mounted onto the building 1.

Thereafter, the first linear water-stopping member 7 is fixed to the horizontal furring strip member 15*b* and the frame member 13, while being disposed between the first corner water-stopping member 11*a* and the second corner water-stopping member 11*b*. Likewise, the second linear water-stopping member 8 is fixed to the horizontal furring strip member 15*b* and the frame member 13, while being disposed between the third corner water-stopping member 11*c* and the fourth corner water-stopping member 11*d*. In addition, the third linear water-stopping member 9 is fixed to the vertical furring strip member 15*a* and the frame member 13, while being disposed between the second corner water-stopping member 11*b* and the third corner water-stopping member 11*c*. Furthermore, the fourth linear water-stopping member 10 is fixed to the vertical furring strip member 15*a* and the frame member 13, while being disposed between the first corner water-stopping member 11*a* and the fourth corner water-stopping member 11*d*. In this way, each of the first to fourth linear water-stopping members 7 to 10 is mounted onto the building 1. The mounting of each of the first to fourth linear water-stopping members 7 to 10 and the first to fourth corner water-stopping members 11*a* to 11*d* onto the building 1 will be described in detail on the basis of the first linear water-stopping member 7.

As shown in FIG. 6, the first linear water-stopping member 7 is mounted on the sash body 3*a* in the building 1 by the plate portion 290 being fixed to the horizontal furring strip member 15*b* and the frame member 13 from the exterior side of the building 1 by means of a first mounting screw 41 (i.e., a fitting) inserted through the mounting hole 290*c*. The first mounting screw 41 corresponds to a screw. As a result of the plate portion 290 being fixed to the horizontal furring strip member 15*b* and the frame member 13 in this way, the supporting portion 291 faces the outer surface 132 of the sash body 3*a*. In addition, the seal portion 292 abuts the outer surface 132, while the sealing material of the seal portion 292 is compressed and deformed between the supporting portion 291 and the outer surface 132. Furthermore, the abutment portion 311 contacts the outer surface 132 of the sash body 3*a* on the exterior side with respect to the seal portion 292 that has been compressed and deformed.

Here, as described above, each of the mounting holes 290*c* is formed in the plate portion 290 at a position spaced apart from the outer surface 132 of the sash body 3*a* farther than the first width W1 of the flange 3*b*. Accordingly, the plate portion 290 is fixed to the horizontal furring strip member 15*b* and the frame member 13 by means of the first mounting screw 41 at a position spaced apart from the outer surface 132 farther than the first width W1. As a result of the plate portion 290 being fixed to the horizontal furring strip member 15*b* and the frame member 13 in this way, a space S corresponding to the thickness of the horizontal furring strip member 15*b* is formed between the interior face 290*b* and the frame member 13. Note that the first linear water-stopping member 7 can be fixed to the horizontal furring strip member 15*b* and the frame member 13 by means of a nail (i.e., a fitting), instead of by means of the first mounting screw 41.

The second linear water-stopping member 8 is mounted onto the building 1 in the downside portion of the sash body 3*a* by the same procedure. Also, the third linear water-stopping member 9 is mounted onto the building 1 on the right side of the sash body 3*a*, and the fourth linear water-stopping member 10 is mounted onto the building 1 on the left side of the sash body 3*a* as shown in FIG.2. At this time, the seal portions 374 and 375 of the first to fourth corner water-stopping members 11*a* to 11*d* are compressed and deformed, while abutting the corresponding side surfaces of first to fourth linear water-stopping members 7 to 10.

In this way, as shown in FIG. 2, the first to fourth linear water-stopping members 7 to 10 and the first to fourth corner water-stopping members 11*a* to 11*d* are mounted onto the building 1 around the sash body 3*a*, thus completing the water-stopping member mounting step.

Next, an exterior building material mounting step is performed in which a plurality of exterior building materials 5 are mounted onto the building 1 as shown in FIG. 6. To mount the exterior building materials 5 to the building 1, at least one engaging groove 5*a* is formed in an end face 50 of each of the exterior building materials 5. Here, to mount the exterior building material 5 to the building 1 in the upside portion of the sash body 3*a*, the distal end portion of each of the securing portions 35*c* of the securing members 35 is inserted into the engaging groove 5*a*. Then, in a state in which the distal end portion of the securing portions 35*c* is inserted into the engaging groove 5*a*, each of the securing members 35 is fixed to the wall portion 310 and the plate portion 290 of the first linear water-stopping member 7 by means of a second mounting screw 43 inserted through the mounting hole 35*d*. At this time, the securing member 35 is fixed to the wall portion 310 and the plate portion 290 such that the securing portions 35*c* are provided at positions located closer to the outer surface 132 of the sash body 3*a* than the first width W1 of the flange 3*b*. The securing members 35 are fixed in a state in which the securing portions 35*c* are oriented to the exterior side of the building 1, and the distal end portions of the securing portions 35*c* are substantially vertically oriented and substantially parallel to the wall portion 310 and the plate portion 290. In this way, the securing portions 35*c* are provided in the side of the exterior face 290*a* of the plate portion 290 at positions located closer to the outer surface 132 of the sash body 3*a* than the first width W1 of the flange 3*b*. Here, at the time of fixing the securing member 35, the distal end of the second mounting screw 43 is retained within the space S. Thus, the distal end of the second mounting screw 43 will not abut not only the flange 3*b*, but also the waterproof sheet 17 nor the waterproof tape 23. Note that the number of the securing members 35 fixed to the first linear water-stopping member 7 can be adjusted as appropriate according to the size of the opening portion 19, in other words, the length of the sash body 3*a* in the left-right direction in FIG. 2.

As a result of the securing member 35 being fixed to the wall portion 310 and the plate portion 290 of the first linear water-stopping member 7, the exterior building material 5 is mounted onto the building 1 in the upside portion of the sash body 3*a* via the first linear water-stopping member 7. At this time, as described above, the outer surface 132 of the sash body 3*a* and the end face 50 of the exterior building material 5 are spaced apart from each other by the interval L. Likewise, as a result of the securing member 35 being fixed to the wall portion 310 and the plate portion 290 of the second linear water-stopping member 8, the exterior building material 5 is mounted onto the building 1 in the downside portion of the sash body 3*a* via the second linear water-stopping member 8.

On the right side and the left side of the sash body 3*a* in FIG. 2, the exterior building material 5 is mounted onto the building 1 by means of a known joint fitting (not shown). On the right side and the left side of the sash body 3*a* in FIG. 2 as well, the outer surface 132 of the sash body 3*a* and the end face 50 of the exterior building material 5 are spaced apart from each other by the interval L. The exterior building materials 5 are mounted onto the building 1 in this way, thus completing the exterior building material mounting step. As a result of the exterior building materials 5 being mounted onto the building 1 in this way, in the outer wall structure, each of the plate portions 290 of the first to fourth linear water-stopping members 7 to 10 and the plate portions 370 of the first to fourth corner water-stopping members 11*a* to 11*d* is located between the exterior building material 5 and the vertical and horizontal furring strip members 15*a*, 15*b*. Note that the screw head of the first mounting screw 41 is located on the interior side with respect to the exterior building material 5, and thus will not be exposed on the exterior side of the exterior building material 5.

After completion of the exterior building material mounting step, a decorative member mounting step is performed in which a decorative member 45 is mounted around the window sash 3, as shown in FIG. 1. As shown in FIG. 8, the decorative member 45 includes a base element 451, a receiving element 452, and a top element 453. Each of the base element 451, the receiving element 452, and the top element 453 is provided in the upside and downside portions and in the left and right side portions of the sash body 3*a*. Accordingly, the lengths, in the longitudinal direction, of the base element 451 and the top element 453 provided in the upside and downside portions of the sash body 3*a* are set according to the length of the sash body 3*a* in the left-right direction in FIG. 1. The lengths, in the longitudinal direction, of the base element 451 and the top element 453 provided in the left and right side portions of the sash body 3*a* are set according to the length of the sash body 3*a* in the up-down direction in FIG.1. In contrast, the receiving element 452 is formed such that the length of the receiving element 452 in the longitudinal direction is shorter than the lengths of the base element 451 and the top element 453 in the longitudinal direction. In the following, a description will be given of the configuration and the assembly procedure on the basis of the base element 451, the receiving element 452, and the top element 453 that are provided in the upside portion of the sash body 3*a*.

The base element 451 is provided with a seal portion 451*a* made of a sealing material such as an ethylene-propylene rubber (EPDM). The seal portion 451*a* has a rectangular shape. In addition, a first engaging portion 451*b* and a housing space 451*c* are formed in the base element 451. A first engaged portion 452*a* and a second engaging portion 452*b* are formed in the receiving element 452. A decorative face 453*a* is formed on the top element 453. Additionally, in the top element 453, a second engaged portion 453*b* is formed on the back side of the decorative face 453*a*.

The base element 451 is fixed to the first linear water-stopping member 7 by means of a third mounting screw 47. Consequently, the base element 451 is located between the end face 50 of the exterior building material 5 and the outer surface 132 of the sash body 3*a* in the side of the exterior face 290*a* in the plate portion 290. The distal end of the third mounting screw 47 penetrates through the auxiliary plate 31 and the water-stopping plate body 29, and is retained in the space S. Accordingly, the distal end of the third mounting screw 47 will not abut not only the flange 3*b*, but also the waterproof sheet 17 nor the waterproof tape 23. In addition, the seal portion 451*a* abuts the wall portion 310, while the seal portion 451*a* is compressed and deformed between the base element 451 and the first linear water-stopping member 7, more specifically, between the base element 451 and the wall portion 310.

The receiving element 452 is assembled to the base element 451 by engaging the first engaging portion 451*b* with the first engaged portion 452*a*. Here, since the length of the receiving element 452 in the longitudinal direction is shorter than the length of the base element 451 in the longitudinal direction as described above, a plurality of receiving elements 452 are assembled to the base element 451. In addition, each of the receiving elements 452 is fixed to the base element 451 by means of a fourth mounting screw 49. The distal end of the fourth mounting screw 49 is retained in the housing space 451*c*.

The top element 453 is assembled to the base element 451 via the receiving elements 452 by engaging the second engaging portions 452*b* of the receiving elements 452 with the second engaged portion 453*b*. In this way, the top element 453 is disposed between the end face 50 of the exterior building material 5 and the outer surface 132 of the sash body 3*a*. Consequently, the first linear water-stopping member 7, the securing member 35, the base element 451, and the receiving element 452, as well as a part of the exterior building material 5 that includes the end face 50 of the exterior building material 5, are covered by the decorative face 453*a*.

The base element 451, the receiving element 452, and the top element 453 are provided in the same manner between the end face 50 of the exterior building material 5 and the outer surface 132 of the sash body 3*a* in the downside, left side and right side portions of the sash body 3*a* in FIG. 2, thus completing the decorative member mounting step. Thus, the installation of the outer wall structure is completed.

The thus installed outer wall structure includes the first to fourth linear water-stopping members 7 to 10 and the first to fourth corner water-stopping members 11*a* to 11*d*. The length from the first end side of the plate portion 290 to the abutment portion 311 of the first to fourth linear water-stopping members 7 to 10 is equal to the second width W2 in the situation that the water-stopping plate body 29 and the auxiliary plate 31 being integrated with each other. Likewise, the length from the first end side of the plate portion 370 to the abutment portion 391 of the first to fourth corner water-stopping members 11*a* to 11*d* is equal to the second width W2 in the situation that the water-stopping plate body 37 and the auxiliary plate 39 being integrated with each other.

Thus, in this outer wall structure, the first to fourth linear water-stopping members 7 to 10 and the first to fourth corner water-stopping members 11*a* to 11*d* each has the second width W2. Also, the plate portions 290 of the first to fourth linear water-stopping members 7 to 10 and the plate portions 370 of the first to fourth corner water-stopping members 11*a* to 11*d* are fixed to the vertical furring strip member 15*a* and the frame member 13 or the horizontal furring strip member 15*b* and the frame member 13 by means of the first mounting screw 41, and are located between the vertical furring strip member 15*a* and the frame member 13 or between the horizontal furring strip member 15*b* and the frame member 13. Consequently, in the first to fourth linear water-stopping members 7 to 10, the seal portion 292 is disposed between the outer surface 132 of the sash body 3*a* and the supporting portion 291 with abutting the outer surface 132 of the sash body 3*a* while the seal portion 292 is compressed and deformed, thus making it possible to prevent entry of water through the boundary between the outer surface 132 of the sash body 3*a* and the plate portion 290. Likewise, in the first to fourth corner water-stopping members 11*a* to 11*d*, the seal portions 372 and 373 are disposed between the outer surface 132 of the sash body 3*a* and the supporting portion 371 with abutting the outer surface 132 of the sash body 3*a* while the seal portion 292 is compressed and deformed, thus making it possible to prevent entry of water through the boundary between the outer surface 132 of the sash body 3*a* and the plate portion 370.

Here, in the building 1, the waterproofing is ensured in advance by providing the waterproof sheet 17 and the waterproof tape 23. The additional waterproofing is also performed around the sash body 3*a* by the seal portions 292, 372, and 373, thus making it possible to prevent entry of water into the interior side of the building 1 in a more preferable manner. Consequently, the building 1 having this outer wall structure exhibits a higher waterproofness.

With this outer wall structure, after each of the first to fourth corner water-stopping members 11*a* to 11*d* has been fixed to the vertical furring strip member 15*a*, the horizontal furring strip member 15*b*, and the frame member 13 around the corner portions of the sash body 3*a*, each of the first to fourth linear water-stopping members 7 to 10 is fixed to the vertical furring strip member 15*a*, the horizontal furring strip member 15*b*, and the frame member 13. Accordingly, with the outer wall structure, the first to fourth linear water-stopping members 7 to 10 and the first to fourth corner water-stopping members 11*a* to 11*d* are easily positioned when they are mounted around the sash body 3*a*.

Also, with this outer wall structure, the plate portion 290 and the plate portion 370 are fixed to vertical furring strip member 15*a* and the frame member 13 or the horizontal furring strip member 15*b* and the frame member 13 by means of the first mounting screw 41 at positions spaced apart from the outer surface 132 of the sash body 3*a* farther than the first width W1 of the flange 3*b*. That is, the plate portion 290 and the plate portion 370 are fixed to the vertical furring strip member 15*a* and the frame member 13 or the horizontal furring strip member 15*b* and the frame member 13 at positions where the flange 3*b* is not present. By being fixed by means of the first mounting screw 41 in this way, the first to fourth linear water-stopping members 7 to 10 and the first to fourth corner water-stopping members 11*a* to 11*d* are easily and firmly fixed to the vertical furring strip member 15*a*, horizontal furring strip member 15*b*, and the frame member 13, as compared with a case where they are fixed, for example, by attachment of an adhesion tape or bonding. Also, with this outer wall structure, the fixation of the plate portion 290 and the plate portion 370 to the vertical furring strip member 15*a*, horizontal furring strip member 15*b*, and the frame member 13 by means of the first mounting screw 41 result in no formation of any additional holes in the flange 3*b* for mounting the exterior building material 5.

With this outer wall structure, the securing member 35 is fixed to the first and second linear water-stopping members 7 and 8 by means of the second mounting screw 43. At this time, the distal end of the second mounting screw 43 is retained in the space S, and thus will not abut not only the flange 3*b*, but also the waterproof sheet 17 nor the waterproof tape 23. Accordingly, the fixation of the securing member 35 will not lead to reduction in the waterproofness of the building 1.

Accordingly, with this outer wall structure, since the seal portions 292, 372, and 373 of the plate portions 290 and 370 seal the boundary between the outer surface 132 of the sash body 3*a* and the plate portions 290 and 370 to waterproof between the sash body 3*a* and the exterior building material 5, it is not necessary to use a caulking compound or the like at the positions between the sash body 3*a* and the exterior building material 5 in order to ensure the waterproofness of the building 1.

Therefore, with the outer wall structure according to Embodiment 1, it is possible to achieve simplified installation and cost reduction, while ensuring the waterproofness of the building 1 onto which the window sash 3 and the exterior building material 5 are mounted.

In particular, with this outer wall structure, the seal portions 292, 372, and 373 abut the outer surface 132 of the sash body 3*a* to waterproof between the outer surface 132 and the plate portions 290 and 370 while the plate portions 290 and 370 are fixed to the vertical furring strip member 15*a*, the horizontal furring strip member 15*b*, and the frame member 13. This makes it possible to waterproof easily, and to reduce a locational variation in the waterproofing capability as compared with a case where a caulking compound is separately filled between the sash body 3*a* and the plate portions 290 and 370. Moreover, this outer wall structure simplifies the installation of the exterior building material 5.

Additionally, the seal portions 374 and 375 are provided on both side faces of the first to fourth corner water-stopping members 11*a* to 11*d*. This makes it possible to prevent entry of water into the interior side of the building 1 through the boundary between the first to fourth linear water-stopping members 7 to 10 and the first to fourth corner water-stopping members 11*a* to 11*d*. The seal portions 374 and 375 thus facilitates the waterproofness between the first to fourth corner water-stopping members 11*a* to 11*d* and the first to fourth linear water-stopping members 7 to 10.

Furthermore, the first to fourth linear water-stopping members 7 to 10 and the first to fourth corner water-stopping members 11*a* to 11*d* include the abutment portions 311 and 391, respectively. Consequently, with this outer wall structure, the abutment portions 311 and 391 shield the seal portions 292, 372, and 373 from the outside environment in the exterior side of the building 1, and it is thus possible to reduce the degradation of the seal portions 292, 372, and 373 due to ultraviolet radiation or the like. Here, since the auxiliary plates 31 and 39 that form the abutment portions 311 and 391 are made of metal, the abutment portions 311 and 391 also have an increased durability to ultraviolet radiation or the like. Accordingly, with this outer wall structure, the first to fourth linear water-stopping members 7 to 10 and the first to fourth corner water-stopping members 11*a* to 11*d* have an increased durability, and it is thus possible to ensure the waterproofness of the building 1 over a long period of time. In addition, with the outer wall structure, it is also possible to enhance the aesthetic appearance of the building 1 by concealing the seal portions 292, 372, and 373 by the abutment portions 311 and 391.

Furthermore, the securing member 35 is fixed to the first and second linear water-stopping members 7 and 8. Accordingly, the first and second linear water-stopping members 7 and 8 enable the waterproofing of the building 1 to be performed between the exterior building material 5 and the outer surface 132 of the window sash body 3*a* in the upside and downside portions of the window sash 3, and also enable the exterior building material 5 to be mounted onto the building 1 in the upside and downside portions of the window sash 3. By engaging the securing portions 35*c* of the securing member 35 with the end face 50 of the exterior building material 5, it is not necessary to perform nailing or screwing in order to mount the exterior building material 5 to the building 1. Accordingly, this outer wall structure will not cause damage of the exterior building material 5 or degradation of the aesthetic appearance of the building 1 during mounting of the exterior building material 5 onto the building 1.

Here, the securing portion 35*c* engages the end face 50 of the exterior building material 5 by the distal end portion of the securing portion 35*c* being inserted into the engaging groove 5*a* formed in the exterior building material 5. Accordingly, this outer wall structure enables the securing portions 35*c* to favorably secure the exterior building material 5 while reducing warping of the exterior building material 5 over time, without separately performing bonding or the like of the exterior building material 5 to the securing member 35 in the first and second linear water-stopping members 7 and 8.

With this outer wall structure, after completion of the exterior building material mounting step, the decorative member mounting step is performed, thus mounting the decorative member 45 around the window sash 3. Consequently, with this outer wall structure, the decorative face 453*a* of the top element 453 covers the first to fourth linear water-stopping members 7 to 10, the first to fourth corner water-stopping members 11*a* to 11*d*, the securing member 35, the base element 451, the receiving element 452, and a part of the exterior building material 5 including the end face 50 of the exterior building material 5. Accordingly, the decorative face 453*a* conceals these members and portions for waterproofing and securing such as the first to fourth linear water-stopping members 7 to 10 so as to further enhance the aesthetic appearance of the building 1.

Here, as mounting the base element 451 of the decorative member 45, the third mounting screws 47 make holes in the first to fourth linear water-stopping members 7 to 10 and the first to fourth corner water-stopping members 11*a* to 11*d*. In view of this, the base element 451 is provided with the seal portion 451*a*. Then, the seal portion 451*a* prevents the entry of water through the hole formed by the third mounting screw 47 into the interior side of the building 1. In addition, the distal end of the third mounting screw 47 is retained within the space S, and the distal end of the fourth mounting screw 49 is retained within the housing space 451*c*, as described above. Accordingly, the distal ends of the third and fourth mounting screws 47 and 49 also will not abut not only the flange 3*b*, but also the waterproof sheet 17 nor the waterproof tape 23. Accordingly, this outer wall structure will not cause reduction of the waterproofness of the building 1 by mounting of the decorative member 45.

(Embodiment 2)

Figure 9A:
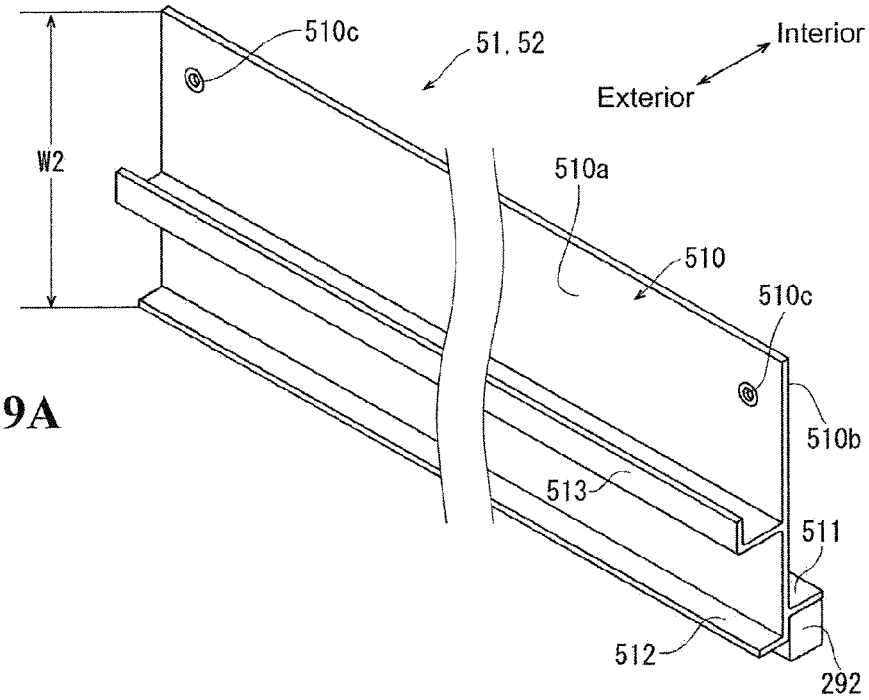
FIG. 9A is a perspective view showing first and second linear water-stopping members according to an outer wall structure of Embodiment 2.

In an outer wall structure according to Embodiment 2, first and second linear water-stopping members 51 and 52 shown in FIG. 9A are used in place of the first and second linear water-stopping members 7 and 8 of the outer wall structure in Embodiment 1. The first and second linear water-stopping members 51 and 52 have the same configuration. In the following, a description will be given of the configuration on the basis of the first linear water-stopping member 51.

Figure 9B:
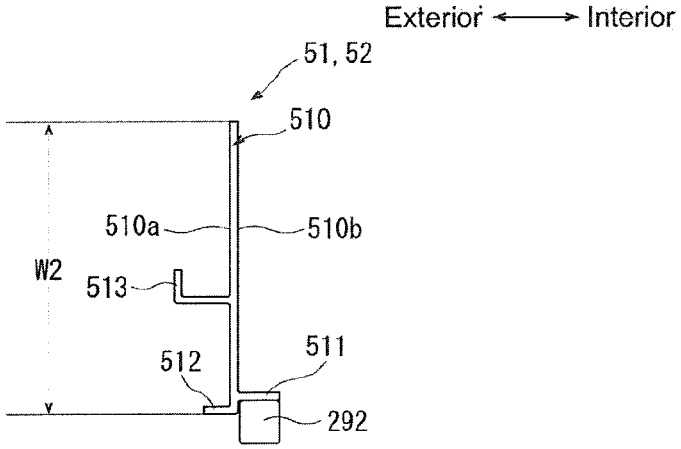
FIG. 9B is a side view showing the first and second linear water-stopping members according to the outer wall structure of Embodiment 2.

The first linear water-stopping member 51 includes a plate portion 510. As shown in FIG. 9B, the plate portion 510 includes an exterior face 510*a* and an interior face 510*b*, which is the back side of the exterior face 510*a*. In addition, as shown in FIG. 9A, the plate portion 510 is also formed of a metal plate extending from one end side (first end side) to the other end side (second end side) in the width direction and also extending in the longitudinal direction, and has the form of a substantially rectangular plate. As with the above-described plate portion 290, the length of the plate portion 510 in the longitudinal direction is set according to the length of the sash body 3*a* in the left-right direction in FIG. 2.

The first linear water-stopping member 51 is formed by extrusion molding such that a supporting portion 511, an abutment portion 512, and a securing portion 513 are integrated with the plate portion 510. The supporting portion 511 is located on the second end side portion of the plate portion 510, and is formed so as to extend from the interior face 510*b* toward the interior side of the building 1 when the first linear water-stopping member 51 is attached in the building 1. The above-described seal portion 292 is provided on the supporting portion 511.

The abutment portion 512 is located at the end portion of the plate portion 510 in the second end side, and is formed so as to extend from the exterior face 510*a* toward the exterior side of the building 1 when the first linear water-stopping member 51 is attached in the building 1. The length from the end portion of the plate portion 510 in the first end side to the abutment portion 511 of the plate portion 510 is also equal to the second width W2, as with the above-described first linear water-stopping member 7.

The proximal end portion of the securing portion 513 extends at a substantially right angle from the exterior face 510*a* of the plate portion 510 in the exterior side of the building 1, and the distal end portion of the securing portion 513 is bent to be substantially vertically oriented and substantially parallel to the plate portion 510. Accordingly, the securing portion 513 has a substantially L-shape as with the above-described securing portion 35*c*, and is formed so as to extend from the exterior face 510*a* in the exterior direction of the building 1. The securing portion 513 is formed on the exterior face 510*a* at a position located closer to the outer surface 132 than the first width W1 of the flange 3*b* when the first linear water-stopping member 51 is fixed to the horizontal furring strip member 15*b* and the frame member 13.

A plurality of mounting holes 510*c* (e.g., two mounting holes 510*c* in FIG. 9(A)) are formed on the first end side of the plate portion 510. The positions of the mounting holes 510*c* in the plate portion 510 are also set such that the plate portion 510 is fixed at a position spaced apart from the outer surface 132 of the sash body 3*a* farther than the first width W1 of the flange 3*b* when the first linear water-stopping member 51 is mounted onto the building 1.

As with the first linear water-stopping member 7, the first linear water-stopping member 51 is disposed in the upside portion of the sash body 3*a* to be fixed to the horizontal furring strip member 15*b* and the frame member 13. As with the second linear water-stopping member 8, the second linear water-stopping member 52 is disposed in the downside portion of the sash body 3*a* to be fixed to the horizontal furring strip member 15*b* and the frame member 13. Then, as with the securing portion 35*c* of the securing member 35, the securing portion 513 secures the end face 50 of the exterior building material 5 by the distal end portion of the securing portion 513 being inserted into the engaging groove 5*a* of the exterior building material 5. In this way, with this outer wall structure as well, the exterior building material 5 is mounted onto the building 1 in the upside and downside portions of the sash body 3*a* via the first and second linear water-stopping members 51 and 52. The rest of the configuration of the outer wall structure is the same as that of the outer wall structure in Embodiment 1. The same components are denoted by the same reference numerals, and the detailed description thereof has been omitted.

This outer wall structure is formed such that the supporting portion 511, the abutment portion 512, and the securing portion 513 are integrated with the plate portions 510 of the first and second linear water-stopping members 51 and 52. Accordingly, this outer wall structure achieves further simplified installation and further cost reduction. The rest of the effect of this outer wall structure is the same as that of the outer wall structure in Embodiment 1.

Although Embodiments 1 and 2 have been described above, the present invention is by no means limited to Embodiments 1 and 2. Needless to say, modifications can be made as appropriate without departing from the scope and spirit of the invention.

For example, in the outer wall structure of Embodiment 1, the supporting portions 291 and 371 are brought into abutment with the flange 3*b* by being formed so as to extend longer in the interior direction of the building 1. In this case, at the time of fixing the securing member 35 to the first and second linear water-stopping members 7 and 8, the first and second linear water-stopping members 7 and 8 are more stable on the outer surface 132 of the sash body 3*a*, thus making it possible to fix the securing member 35 easily.

The supporting portion 291 and the abutment portion 311 can be formed integrally with the plate portion 290. Likewise, only the supporting portion 511 and the abutment portion 512 can be formed integrally with the plate portions 510 of the first and second linear water-stopping members 51 and 52 while the securing portion 513 is formed as a separated part from the plate portions 510.

Furthermore, in the outer wall structure of Embodiment 1, only the first to fourth linear water-stopping members 7 to 10 can be fixed to the vertical furring strip member 15*a*, the horizontal furring strip member 15*b*, and the frame member 13, without using the first to fourth corner water-stopping members 11*a* to 11*d*. In this case, it is possible to achieve further cost reduction. The same applies to the outer wall structure of Embodiment 2.

The outer wall structures of Embodiments 1 and 2 can be installed without performing the decorative member mounting step.

Furthermore, depending on the position at which the window sash 3 is provided in the building 1, the first linear water-stopping member 7 and the like may be mounted onto only one location, for example, only in the upside portion of the sash body 3*a*. This modification applies to a case where an opening member other than the window sash 3 such as a door is provided in the building 1.

In the outer wall structure of Embodiment 1, in order to mount the exterior building material 5 to the building 1 in the upside and downside portions of the sash body 3*a*, the engaging groove 5*a* is formed in the end face 50 of the exterior building material 5. Then, the securing portions 35*c* engage the end face 50 of the exterior building material 5 by the distal end portion of the securing portions 35*c* being inserted into the engaging groove 5*a*. Likewise, in the outer wall structure of Embodiment 2, the securing portion 513 engages the end face 50 of the exterior building material 5 by the distal end portion of the securing portion 513 being inserted into the engaging groove 5*a* formed in the end face 50 of the exterior building material 5. Instead of these, while omitting the engaging groove 5*a* in the end face 50 of the exterior building material 5, the exterior building material 5 can be mounted onto the building 1 by a longer proximal end portions of the securing portions 35*c* and 513 extending to the exterior side of the exterior building material 5, so that the end face 50 of the exterior building material 5 is placed on the horizontal proximal side potions of the securing portions 35*c* and 513 and the front face of the exterior building material 5 is supported by the distal end side potions of the securing portions 35*c* and 513.

Furthermore, the first to fourth linear water-stopping members 7 to 10 in the outer wall structure of Embodiment 1 can have the same configuration, without mounting the securing member 35 onto the first and second linear water-stopping members 7 and 8. In this case, the exterior building material 5 is mounted onto the building 1 by providing a spacer member having a predetermined size between the exterior building material 5 and the wall portion 310 of the first and second linear water-stopping members 7 and 8 in the upside and downside portions of the sash body 3*a*, and the exterior building material 5 is fixed to the building 1 by nailing, screwing or the like. This modification applies to Embodiment 2 in a case where the securing portion 513 is not formed in the first and second linear water-stopping members 51 and 52.

Embodiments 1 and 2 are applicable to houses and various other buildings.

What is claimed is:

1. A water-stopping flange-covering member suitable for use in a building having a flanged opening member and an exterior building material, for waterproofing a boundary portion between the flanged opening member and the exterior building material, wherein the building includes a frame member, and a wall backing material that is mounted to the frame member and is located between the frame member and an interior side of the exterior building material; and the flanged opening member includes an opening member body, and a flange having a first width that extends outward from an outer surface of the opening member body, which the flange is capable of being fixed on an exterior-facing side of the frame member;

the water-stopping flange-covering member comprising:

a vertical plate portion having a frame-facing side capable of being fixed to at least one of the wall backing material and the frame member, and which is capable of being located between the wall backing material or frame member and the exterior building material;

a supporting portion provided at a first end portion of the frame-facing side of the vertical plate portion; and a sealing member joined to the supporting portion and capable of preventing entry of water by abutting the opening member body, wherein the vertical plate portion possesses a width that is greater than the first width of the outwardly extending flange and is also greater than an interval existing between the opening member body and the exterior building material, the vertical plate portion is capable of being fixed to at least one of the wall backing material and the frame member at a position spaced apart from a furthest edge of the flange outwardly extending from the opening member body and with the sealing member abutting an outer surface of the opening member body, the vertical plate portion includes an abutment portion capable of concealing the sealing member while abutting the outer surface of the opening member body, the abutment portion is formed to extend in an exterior-facing direction of the building, and the supporting portion is formed to extend in an interior-facing direction of the building when the vertical plate portion abuts the outer surface of the opening member body.

2. The water-stopping flange-covering member according to claim 1, wherein an engaging groove is formed in an end face of the exterior building material, the vertical plate portion includes a securing portion capable of mounting the exterior building material to the building by engaging the engaging groove, the securing portion configured to be fixed on an exterior-facing side of the vertical plate portion, and the securing portion is located closer to the opening member body than the furthest edge of the flange outwardly extending from the opening member body when the vertical plate portion is fixed to at least one of the wall backing material and the frame member.

3. An outer wall structure including the water-stopping flange-covering member according to claim 2.

4. The water-stopping flange-covering member according to claim 1, wherein the vertical plate portion is capable of being fixed by a fitting.

5. An outer wall structure including the water-stopping flange-covering member according to claim 4.

6. The water-stopping flange-covering member according to claim 4, wherein the fitting is at least one of a screw and a nail.

7. An outer wall structure including the water-stopping flange-covering member according to claim 1.

8. An outer wall structure of a building, comprising:

a frame member;

an exterior building material;

a wall backing material that is fixed on an exterior-facing side of the frame member and is located between the frame member and an interior-facing side of the exterior building material;

a flanged opening member comprising an opening member body, and a flange having a first width that extends outward from an outer surface of the opening member body, which the flange is capable of being fixed on an exterior-facing side of the frame member; and a water-stopping flange-covering member for waterproofing a boundary portion between the flanged opening member and the exterior building material, wherein i) the water-stopping flange-covering member comprises:

a vertical plate portion having a frame-facing side capable of being fixed to at least one of the wall backing material and the frame member, and which is capable of being located between the wall backing material or frame member and the exterior building material;

a supporting portion provided at a first end portion of the frame-facing side of the vertical plate portion; and a sealing member joined to the supporting portion and capable of preventing entry of water by abutting the opening member body, wherein the vertical plate portion possesses a width that is greater than the first width of the outwardly extending flange and is also greater than an interval existing between the opening member body and the exterior building material, and the vertical plate portion is capable of being fixed to at least one of the wall backing material and the frame member at a position spaced apart from a furthest edge of the flange outwardly extending from the opening member body and with the sealing member abutting an outer surface of the opening member body, ii) the opening member is disposed on the frame member by fixing the flange of the opening member to the exterior-facing side of the frame member, and iii) the water-stopping flange-covering member is disposed between the wall backing material and the exterior building material so that the vertical plate portion of the water-stopping flange-covering member is fixed to at least one of the wall backing material and the frame member, and the supporting portion of the water-stopping flange-covering member abuts the outer surface of the opening member body via the sealing member to prevent entry of water, wherein the vertical plate portion includes an abutment portion so that the abutment portion of the vertical plate portion abuts the outer surface of the opening member body to conceal the sealing member, the abutment portion is formed to extend in an exterior-facing direction of the building, and the supporting portion is formed to extend in an interior-facing direction of the building.

9. The An outer wall structure of a building, comprising:

a frame member;

an exterior building material;

a wall backing material that is fixed on an exterior-facing side of the frame member and is located between the frame member and an interior-facing side of the exterior building material;

a flanged opening member comprising an opening member body, and a flange having a first width that extends outward from an outer surface of the opening member body, which the flange is capable of being fixed on an exterior-facing side of the frame member; and a water-stopping flange-covering member for waterproofing a boundary portion between the flanged opening member and the exterior building material, wherein i) the water-stopping flange-covering member comprises:

a vertical plate portion having a frame-facing side capable of being fixed to at least one of the wall backing material and the frame member, and which is capable of being located between the wall backing material or frame member and the exterior building material;

a supporting portion provided at a first end portion of the frame-facing side of the vertical plate portion; and a sealing member joined to the supporting portion and capable of preventing entry of water by abutting the opening member body, wherein the vertical plate portion possesses a width that is greater than the first width of the outwardly extending flange and is also greater than an interval existing between the opening member body and the exterior building material, and the vertical plate portion is capable of being fixed to at least one of the wall backing material and the frame member at a position spaced apart from a furthest edge of the flange outwardly extending from the opening member body and with the sealing member abutting an outer surface of the opening member body, ii) the opening member is disposed on the frame member by fixing the flange of the opening member to the exterior-facing side of the frame member, and iii) the water-stopping flange-covering member is disposed between the wall backing material and the exterior building material so that the vertical plate portion of the water-stopping flange-covering member is fixed to at least one of the wall backing material and the frame member, and the supporting portion of the water-stopping flange-covering member abuts the outer surface of the opening member body via the sealing member to prevent entry of water, wherein an engaging groove is formed in a lower end face of the exterior building material, the vertical plate portion of the water-stopping flange-covering member has a securing portion capable of mounting the exterior building material to the building by engaging the engaging groove, the securing portion is disposed on an exterior-facing side of the vertical plate portion, the securing portion is located closer to the opening member body than the furthest edge of the flange outwardly extending from the opening member body when the vertical plate portion is fixed to at least one of the wall backing material and the frame member, and the engaging groove of the exterior building material is mounted to the securing portion such that the exterior building material is fixed.

10. An outer wall structure of a building, comprising:

a frame member;

an exterior building material;

a wall backing material that is fixed on an exterior-facing side of the frame member and is located between the frame member and an interior-facing side of the exterior building material;

a flanged opening member comprising an opening member body, and a flange having a first width that extends outward from an outer surface of the opening member body, which the flange is capable of being fixed on an exterior-facing side of the frame member; and a water-stopping flange-covering member for waterproofing a boundary portion between the flanged opening member and the exterior building material, wherein i) the water-stopping flange-covering member comprises:

a vertical plate portion having a frame-facing side capable of being fixed to at least one of the wall backing material and the frame member, and which is capable of being located between the wall backing material or frame member and the exterior building material;

a supporting portion provided at a first end portion of the frame-facing side of the vertical plate portion; and a sealing member joined to the supporting portion and capable of preventing entry of water by abutting the opening member body, wherein the vertical plate portion possesses a width that is greater than the first width of the outwardly extending flange and is also greater than an interval existing between the opening member body and the exterior building material, and the vertical plate portion is capable of being fixed to at least one of the wall backing material and the frame member at a position spaced apart from a furthest edge of the flange outwardly extending from the opening member body and with the sealing member abutting an outer surface of the opening member body, ii) the opening member is disposed on the frame member by fixing the flange of the opening member to the exterior-facing side of the frame member, and iii) the water-stopping flange-covering member is disposed between the wall backing material and the exterior building material so that the vertical plate portion of the water-stopping flange-covering member is fixed to at least one of the wall backing material and the frame member, and the supporting portion of the water-stopping flange-covering member abuts the outer surface of the opening member body via the sealing member to prevent entry of water, wherein the outer wall structure further comprises a securing member having a securing portion, wherein an engaging groove is formed in a lower end face of the exterior building material, the securing portion of the securing member is capable of mounting the exterior building material to the building by engaging the engaging groove, the securing member is configured to be fixed on the exterior-facing side of the vertical plate portion, the securing member is disposed on the exterior-facing side of the vertical plate portion such that the securing portion of the securing member is located closer to the opening member body than the furthest edge of the flange outwardly extending from the opening member body when the vertical plate portion is fixed to at least one of the wall backing material and the frame member, and the engaging groove of the exterior building material is mounted to the securing portion of the securing member such that the exterior building material is fixed.

* * * * *